US005722860A

United States Patent [19]

Pan

[11] Patent Number: 5,722,860

[45] Date of Patent: Mar. 3, 1998

[54] WATERTIGHT SOCKET STRUCTURE FOR USE IN A LIGHT BULB SERIES

[76] Inventor: Wun Fang Pan, 125, Lane 99, Din Pu Road, Hsinchu, Taiwan

[21] Appl. No.: 761,373

[22] Filed: Dec. 9, 1996

[51] Int. Cl.[6] ..... H01R 17/00

[52] U.S. Cl. ..... 439/619; 439/699.2

[58] Field of Search ..... 439/611–619, 699.2

[56] References Cited

U.S. PATENT DOCUMENTS

| | | | |
|---|---|---|---|
| 2,984,813 | 5/1961 | Bossi | 439/619 |
| 3,104,924 | 9/1963 | Capel | 439/619 |
| 3,396,363 | 8/1968 | Suzuki | 439/619 |
| 3,522,579 | 8/1970 | Matsuya | 439/619 |
| 5,443,399 | 8/1995 | Jing et al. | 439/619 |

*Primary Examiner*—Hien Vu

*Attorney, Agent, or Firm*—Morton J. Rosenberg; David I. Klein; Jun Y. Lee

[57] ABSTRACT

The present invention relates to an improved light bulb socket structure for use in a decorative light bulb series which is provided with a rod on the bottom of the light bulb holder to embrace the electrical wires with the walls of the light bulb socket and to close the opening on the bottom of the socket body in a watertight manner. The inventive socket structure can prevent water or moisture from penetrating into the interior of the socket body and deteriorating the conductor parts of the socket.

1 Claim, 4 Drawing Sheets

WATERTIGHT SOCKET STRUCTURE FOR USE IN A LIGHT BULB SERIES

SUMMARY OF THE INVENTION

Decorative light bulb series is often used outdoors and thus it must be provided with a waterproofing feature to keep rain water or moisture from penetrating into the inside and deteriorating the conductor parts of the socket and further to induce the short out of the light bulb series. An improved structure, as in U.S. Ser. No. 08/603,420 is provided with sealing elements, combined with conductor plates and electrical conductor wires, are arranged inside the socket in such a way that lower end of the socket is closed in a watertight manner to prevent water or moisture from penetrating into the interior of the socket body and deteriorating the conductor parts of the socket. This structure includes an extra element, sealing elements, and it increases cost and assembled time. Moreover, when the sealing elements arranged in a wrong angle or improper position, it may cause gaps between conductor wire and socket walls/sealing elements which constitute an access for water or moisture as a prior structure.

The primary object of the present invention is to provide an improved watertight socket structure that is effectively and completely impervious to water, eliminating the drawback of the prior art bulb sockets.

Now the present invention will be described in detailed with reference to the accompanying drawings.

BRIEF DESCRIPTION OF THE INVENTION

DETAILED DESCRIPTION OF A PREFERRED EMBODIMENT

Figure 1:
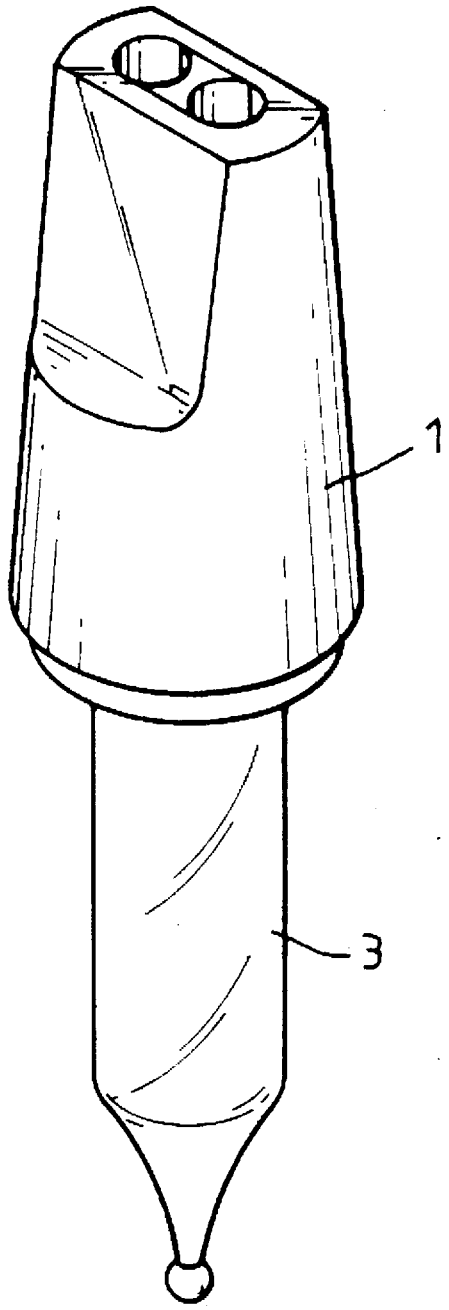
FIG. 1 is a perspective view of an assembled light bulb socket according to the present invention.
Figure 2:
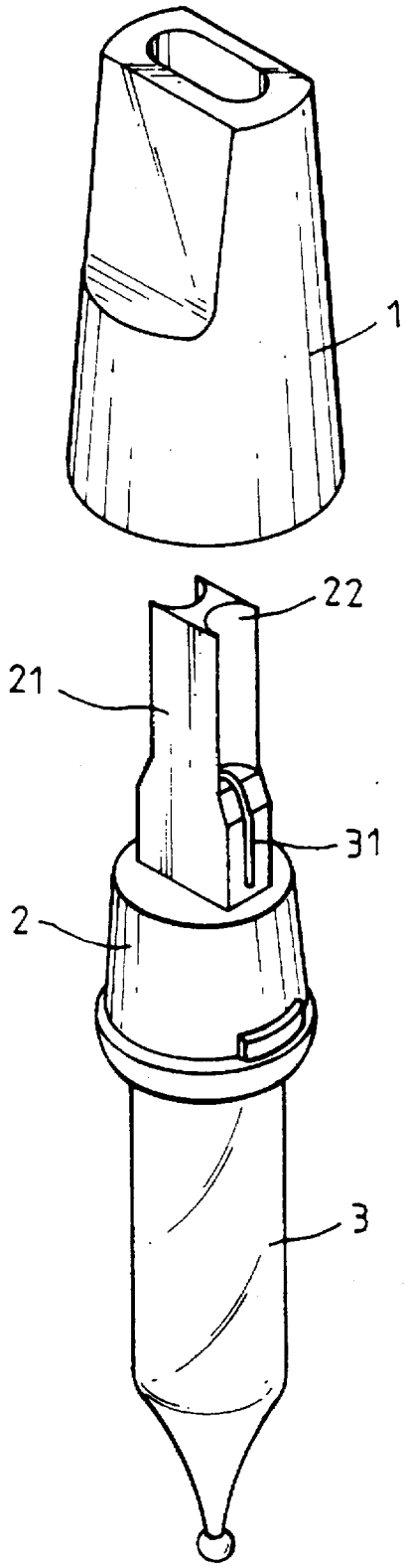
FIG. 2 is an exploded perspective view of FIG. 1 of this invention.
Figure 3:
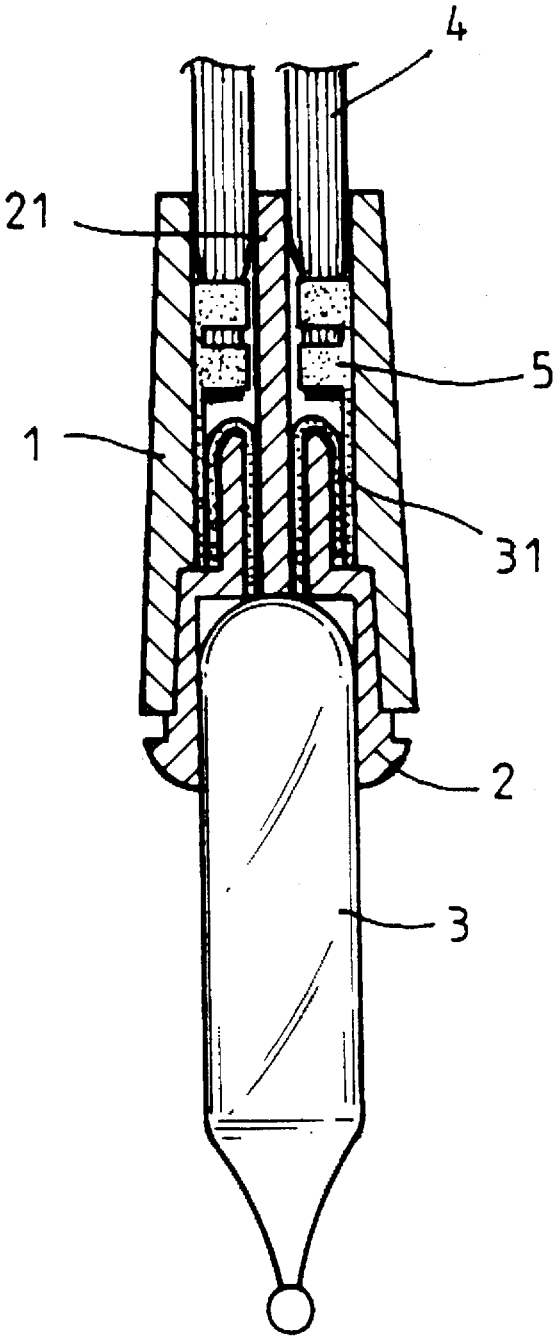
FIG. 3 is a cross sectional view of FIG. 1 of the invention.

Referring to FIGS. 1 to 3, the light bulb socket structure of the present invention comprises a socket body (1), a light bulb holder (2), and a light bulb (3). Similar to a conventional structure, the light bulb (3) is held in the holder (2) and the holder (2) is mounted on the top of the socket body (1). For these parts the invention light bulb socket has the same structure with the same watertight feature as a conventional socket. However, the characteristic of the present invention is further provided with the socket body (1) having a pair of opposing open end portions with one end portion having an oval shape and a rod (21) extended from the bottom of the holder (2). The rod (21) has a pair of flat walls and in the sides thereof between the flat walls there is formed a pair of arched grooves (22). When the holder (2) is mounted on the top of the socket body (1), the arched grooves (22) of the rod (21) are positioned within the oval shaped end portion, the rod (21) separating the inner space of the socket body (1) into two independent wire receiving spaces for containing a pair of electrical wires (4) with conductor plates (5) and the conductor wires (31) of light bulb (3). Under this connection, the electrical wires (4) are snugly embraced between the rod (21) and the socket walls of the body (1) that closes the opening on the bottom of the socket body (1) to ensure the waterproofness of the socket.

Figure 4:
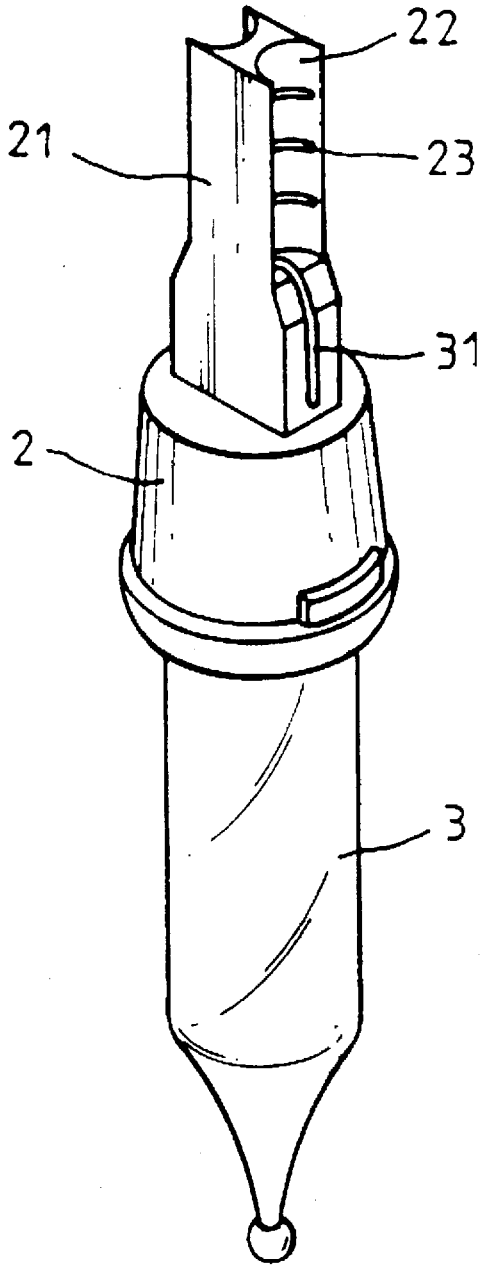
FIG. 4 is a modified perspective view of the light bulb socket in accordance with the present invention.

When used in a bigger light bulb socket, it is possible to provide some parallel projected rings (23) on the grooves (22), as shown in FIG. 4, that will increase the pressed force on the electrical wires (4) to obtain a better firm engagement. However, even if there is some water flowing into the socket body (1), it will not be dangerous because the water may not contact the two conductor wires (31) of the bulb (3) or two conductor plates (5) at the same time due to the separating rod (21) being provided.

Therefore, the light bulb socket according to the present invention can achieve a complete waterproofing effect preventing the penetration of water or moisture into the interior of the socket and the deterioration of electrical conductor parts.

I claim:

1. A light bulb socket structure for use with decorative light bulbs having conductor wires, comprising:

a socket body having a cavity formed therein and extending between a pair of opposing open end portions, one of said end portions having an oval shape;

a light bulb holder engaged with said socket body within said cavity, said light bulb holder having a light bulb receiving cavity formed on one end thereof, said light bulb holder having a longitudinally extended rod portion extending from a bottom wall of said light bulb receiving cavity and formed integrally therewith in one piece formation, said rod portion being disposed within said cavity of said socket body and having a pair of flat walls and a pair of longitudinally extended arcuate grooves respectively formed between said pair of flat walls of said rod portion, said pair of longitudinally extended arcuate grooves being fitted in said oval shaped portion to define two separate and distinct wire receiving channels; and, a pair of electrical wires and the conductor wires being respectively disposed in said pair of wire receiving channels, said electrical wires and wire receiving channels being respectively dimensioned to form a substantially watertight fit therebetween.

* * * * *